US005778959A

United States Patent [19]

Guetschow

[11] Patent Number: 5,778,959

[45] Date of Patent: Jul. 14, 1998

[54] PORTABLE DISPLAY SCREEN

[76] Inventor: Keith Guetschow, 1837 Blackhawk Blvd., South Beloit, Ill. 61080

[21] Appl. No.: 701,860

[22] Filed: Aug. 23, 1996

[51] Int. Cl.[6] ..... E06B 3/48

[52] U.S. Cl. ..... 160/231.2; 160/135; 160/229.1; 160/231.1; 160/351; 40/606

[58] Field of Search ..... 160/231.1, 231.2, 160/232, 234, 351, 353, 135, 377, 229.1; 40/606, 610; 52/630, 646, 783.11, 783.19

[56] References Cited

U.S. PATENT DOCUMENTS

| | | | |
|---|---|---|---|
| 3,727,874 | 4/1973 | Wuensch | 248/459 |
| 4,785,565 | 11/1988 | Kuffner | 40/605 |
| 5,220,952 | 6/1993 | Beaulieu | 160/231.1 |
| 5,375,641 | 12/1994 | Schlueter | 160/135 |

*Primary Examiner*—Kenneth J. Dorner
*Assistant Examiner*—Bruce A. Lev
*Attorney, Agent, or Firm*—Mallinckrodt & Mallinckrodt

[57] ABSTRACT

A reusable lightweight folding screen or partition is composed of slim shallow panels interconnected in edge-to-edge abutment by a plurality of elastic thread means. The elastic thread means are disposed within each panel and extend between adjacent panels through corresponding apertures in the contacting edge wall of neighboring panels. The elastic thread means are adapted to maintain said panels in abutment and to permit the screen to fold along said edges. An anchorage flap adapted to anchor one end of the elastic thread means and to facilitate rigidity in the panel by spreading the load developed in the elastic thread means over an area of the panel is provided within each panel. Said anchorage flaps are positioned such that the elastic thread means extend without abrupt changes in direction between their anchorage points. Each panel comprises a rectilinear backing frame overlaid by a rectilinear cover sheet to provide a neat sharp edge about one face of the panel.

17 Claims, 4 Drawing Sheets

PORTABLE DISPLAY SCREEN

SPECIFICATION

BACKGROUND OF THE INVENTION

1. Field

This invention relates to portable screens and more particularly to lightweight portable folding screens forming exhibition booths and support for advertising material.

2. State of the Art

Screens or partitions have a variety of applications including, for example, to form an exhibitor's booth at an exhibition, to provide a support for the display of advertising material generally, or to perform as a light-weight folding partition or screen.

The present invention has arisen from the need for a reusable inexpensive lightweight folding screen to form a display booth, but it will be appreciated from the ensuing description that it may be applied to screen assemblies in other fields as well.

Various prior art display screens have been made of individual panels interconnected in edge-to-edge abutment using a variety of connecting means. U.S. Pat. No. 4,785,565 shows interconnecting of panels with connectors configured to fit into specially formed tubing which holds the display panels. However, such screens are not foldable, but are disassembled into individual panels for storage or transportation. U.S. Pat. No. 5,375,641 shows interconnecting of rows of panels with elastic material extending through channels in the panels so that the rows can be configured as desired by a user. The rows are extended vertically by rigid interconnection of panels. Again, the screen is not shown as folded for storage or transportation, but is disassembled into individual panels. U.S. Pat. No. 5,220,952 shows the edge-to-edge interconnection of panels by elastic material both horizontally and vertically. Such connections, however, require individual attachment of the elastic between each panel by a slidable locking means on the adjacent panel. While the screen is foldable, the individual panel attachments are provided so sections of the screen can be separated for storage and transportation.

SUMMARY OF THE INVENTION

According to one aspect, the invention provides a screen comprising at least two panels assembled in edge-to-edge array by elastic thread means, each panel comprising a cover element and a backing frame wherein the backing frame is formed from a cut and scored cardboard blank, the blank being adapted to fold to form a slim rectilinear prism having two major faces and three or more minor faces, said minor faces abutting each other in the screen assembly and each being provided with a number of corresponding apertures through which said elastic thread means extends, one of said major faces forming a support for the cover element, the other major face forming the back face of a panel, and wherein the backing frame is overlaid with the cover element to define a laminar panel.

Preferably anchorage means are provided within the marginal panels of the array adapted to secure the ends of the thread means.

According to another aspect, the invention provides a screen comprising two or more panels assembled in edge-to-edge array and elastic thread means adapted to maintain neighboring panels in edge-to-edge abutment, extending through corresponding apertures in abutting edge walls of the neighboring panels, wherein each marginal panel is provided with at least one anchorage means in the form of an anchorage flap adapted to anchor the elastic thread means and adapted to enhance the rigidity of the panel by spreading the load developed in the elastic thread means over an area of the panel.

According to yet another aspect, the invention provides a screen comprising at least two panels interconnected in edge-to-edge array by elastic thread means, each panel comprising a first member and a second member, the first member being formed from a cut and scored blank, the blank being adapted to fold to form a rectilinear prism having two major faces and three or more minor faces wherein at least one minor face is provided with at least one aperture through which elastic thread means extend and the second member being a flat sheet mounted to overlie one major face of the first member, wherein at least one anchorage means is provided within each marginal panel of the array adapted to secure an end of said thread means and enhance the rigidity of the panel within which it is sited.

Preferably, the thread means extend substantially unidirectionally from one anchorage means to another. Accordingly, the thread means does not execute an abrupt change in direction intermediate its anchorage means.

The invention also consists in a panel for incorporation in screens of the invention comprising a panel comprising a first member, a second member, and anchorage means, the first member being formed from a cut and scored blank, the blank being adapted to fold to form a rectilinear prism having two major faces and three or more minor faces wherein at least one minor face is provided with at least one aperture through which elastic thread means may extend, wherein said anchorage means is adapted to anchor such a thread means, and wherein said second member is mounted to overlie said one major face of the first member.

The panels are, preferably, of cardboard or plastics equivalent material or other light weight material and may, for example, be formed of corrugate B flute, two-ply board. When comprising two members, namely a first member or backing frame and a second member or cover element, those members may be formed of different material.

Preferably the backing frame comprises a shallow box formed from a cut and scored cardboard blank, the blank being adapted to fold to form a slim rectilinear prism having two major faces and three or more minor faces, said minor faces abutting each other in the screen assembly and each being provided with a number of corresponding apertures through which said elastic thread means extends, one of said major faces forms the back face of a panel, the other major face forms a support for the cover element. Said other major face may be provided with a central recess portion.

Preferably the blank includes integral flaps adapted to fold along score lines to support portions of the blank forming said other major face a predetermined height above the back face of the panel. These flaps may, for example, be adhered or otherwise mounted to the inner surface of the one major face and may assist in providing rigidity to the backing frame.

In the case of marginal panels, an anchorage flap may, for example, be adhered or otherwise mounted to the inner surface of the one major face within said recess portion.

Preferably the cover element is a cut rectilinear piece of art board, corrugated plastic board, foamed plastic or other lightweight, rigid sheet material. It has square cut, square butt or otherwise sharp edges, is positioned to overlay the front face of the backing frame, and is mounted thereto to form a rectilinear prism panel presenting a neat sharp edge about one face thereof.

Accordingly, the panel may be said to have at least one face having at least one edge not defined by a fold line.

The elastic thread means may be in the form of a thong, string, or braided cable. Preferably each end of each thread means is tied or otherwise fixed to anchorage means in the form of an anchorage flap within the relevant panel. Each anchorage flap is adapted to extend from an inner face of a panel and may, for example, be mounted thereto by adhesive means. In an assembled screen the elastic thread means may extend directly from an anchorage flap proximate an outer edge of the screen to another anchorage flap proximate an opposite outer edge.

For preference, all flaps are adhered to the backing frames of two member panels.

THE DRAWINGS

The best mode presently contemplated for carrying out the invention is illustrated in the accompanying drawings, in which.

Figure 1:
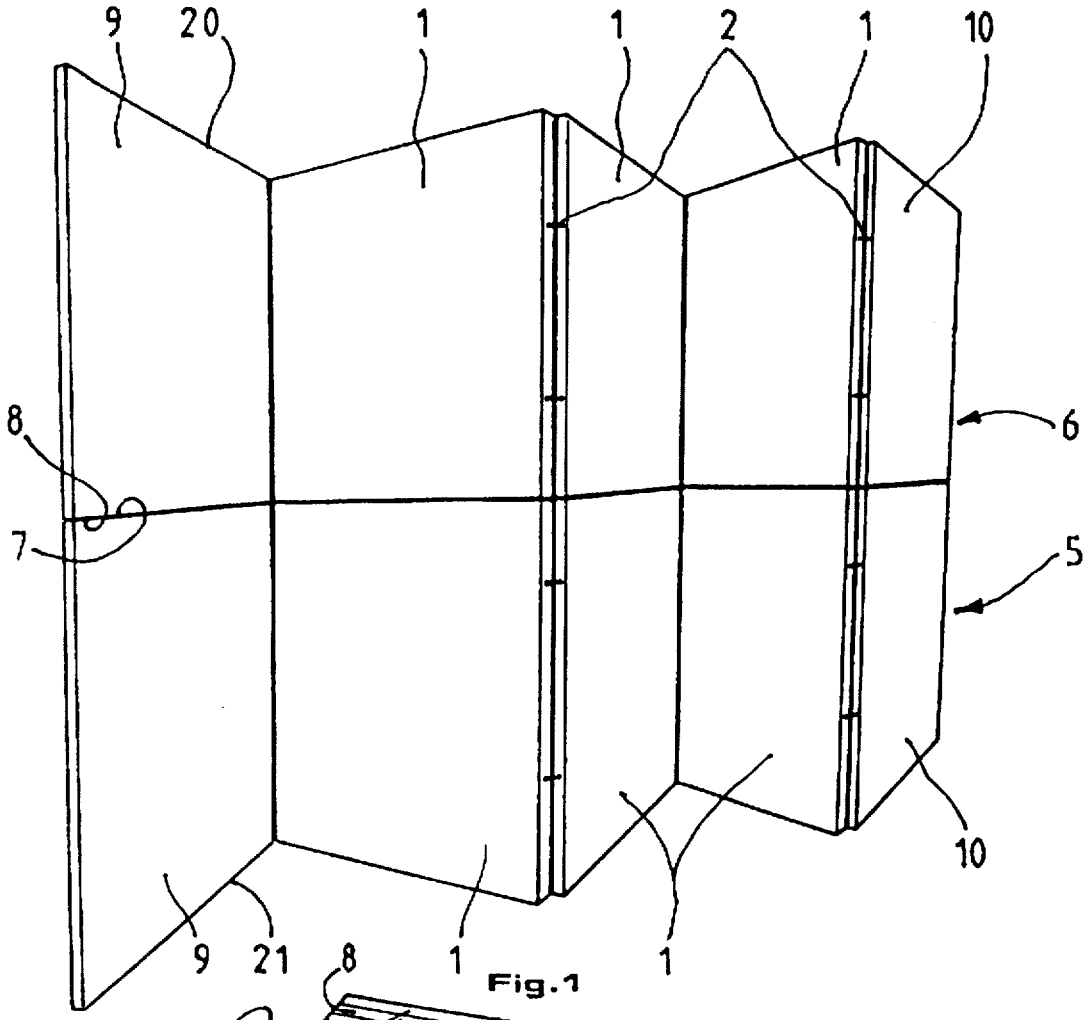
FIG. 1 is a perspective view of a screen according to the invention shown unfolded.
Figure 2:
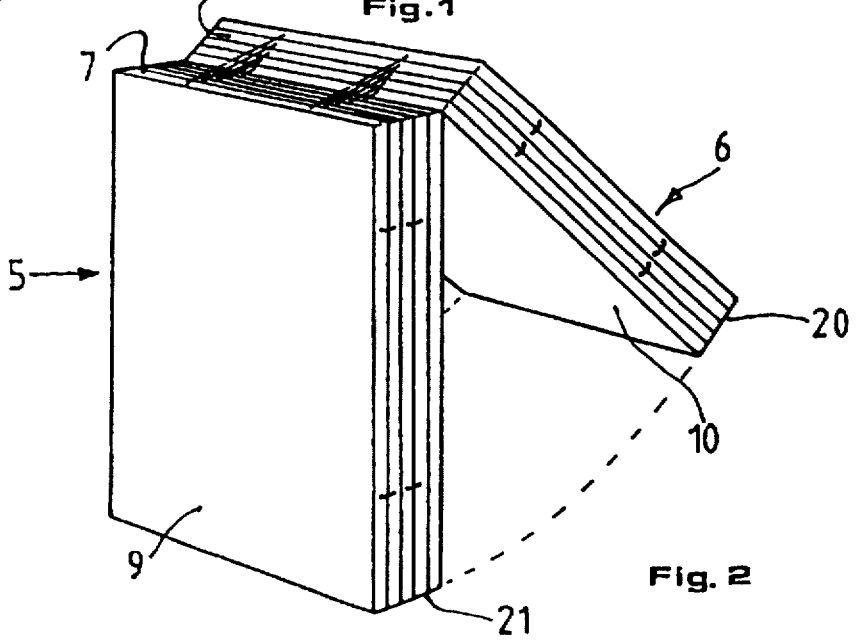
FIG. 2 is a perspective view of the screen of FIG. 1 shown in part folded position.
Figure 4:
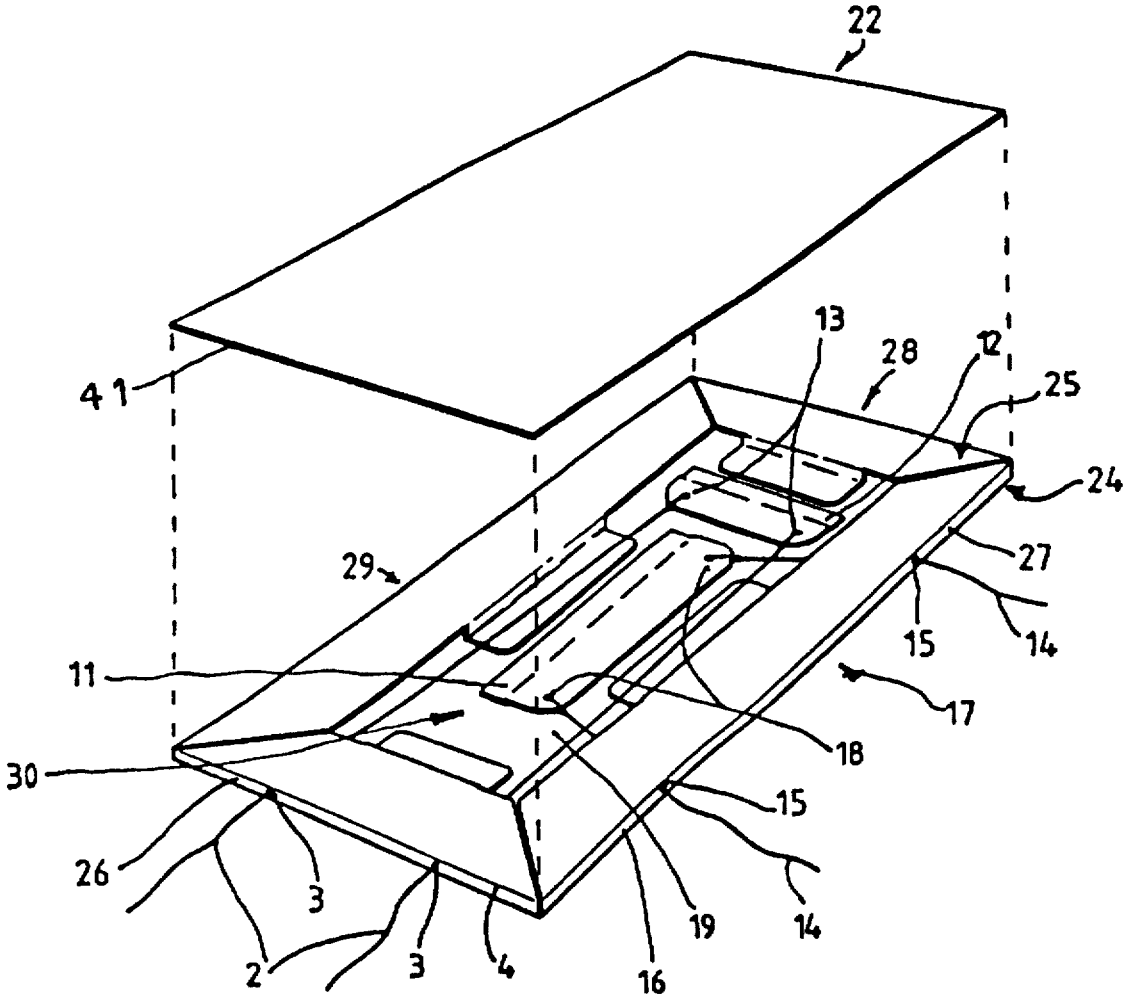

FIG. 4 an exposed perspective view of a panel being a component of the screen shown in FIG. 1, illustrating a backing frame and a cover element prior to final assembly, drawn to a larger scale.

Figure 5:
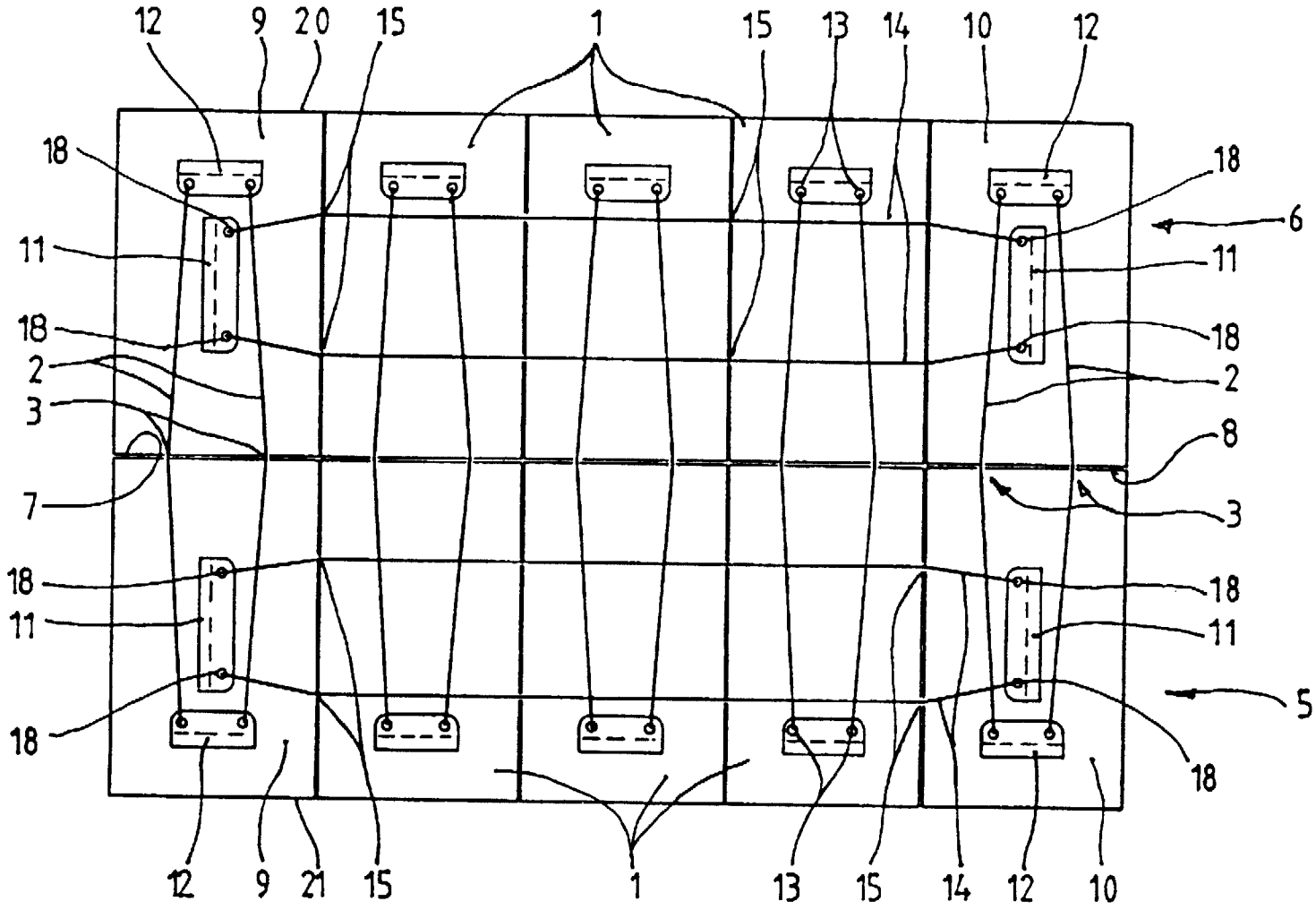

FIG. 5 a schematic view of an assembled screen illustrating the relative positions of the anchorage means and the disposition of elastic thread means.

DETAILED DESCRIPTION OF THE ILLUSTRATED EMBODIMENT

The illustrated embodiment comprises a screen composed of ten slim shallow rectangular cardboard panels 1 hingedly interconnected in edge-to-edge abutment by elastic thread means 2. These elastic thread means 2 are disposed within each panel 1 and extend between neighboring panels through corresponding apertures 3 in abutting edge walls 4 of neighboring panels. In this instance all of the panels are at one edge of the screen, that is to say, all of them are marginal panels, as that term is used herein.

The screen may be said to comprise two linear arrays 5, 6, each array comprising five panels, wherein a top edge 7 of one array 5 is held in edge-to-edge abutment with a bottom edge 8 of the other array 6 by elastic thread means 2. Each panel 1 of the screen is identical except that the end panels 9, 10 of each array are each provided with a transverse anchorage means 11, as illustrated in FIG. 4.

The two linear arrays 5, 6 are maintained in said edge-to-edge abutment by ten elastic thread means 2, each in the form of braided elastic cable extending through corresponding apertures 3 in abutting edge walls 4 of neighboring panels. Each neighboring panel is provided with an anchorage flap 12 positioned within each panel and mounted remote from said abutting edge wall 4. The anchorage flap 12 extends from an inner face of a backing frame being a component of the panel. Each anchorage flap 12 is provided with two apertures or anchorage points 13 so that two cables 2 may be tied or otherwise affixed thereto. Each abutting edge wall 4 is provided with two corresponding apertures 3. Each panel of one array is therefore maintained in edge-to-edge abutment with one panel of the other array by two elastic cables extending through corresponding apertures 3 in an abutting edge wall 4 of said neighboring panels. The lines of action of the cables remain substantially within the confines of the panel edges, and the cables themselves remain substantially within the confines of the screen edges.

Each linear array 5, 6 is formed of five panels positioned side-by-side wherein each neighboring panel is maintained in edge-to-edge abutment by two elastic thread means 14, each in the form of an elastic cable, extending through corresponding apertures 15 in abutting edge walls 16 of neighboring panels. The end of each cable is tied or otherwise fixed to the transverse anchorage means 11. Said transverse anchorage means 11, each in the form of an anchorage flap, is provided within each of the end panels 9, 10 in the array, and each cable 14 extends through the three intermediate panels 1. Each transverse anchorage flap 11 is also adhered to or otherwise mounted to an inner face of a backing frame 17 being a component of the relevant panel. The line of action of each cable 14 does not deviate substantially from a straight line defined by its two anchorage points 18. The axes of the corresponding aperture 15 through which each cable extends define a substantially straight line between the anchorage points 18, that is to say, the cable does not display an abrupt change in direction intermediate its anchorages points 18, particularly not at or proximate the corresponding apertures 15. FIG. 5 illustrates the corresponding apertures 15 slightly offset to the line intersecting each set of anchorage points 18 for each cable, however this represents a slight change in direction and not an abrupt change, and is provided to facilitate alignment of neighboring panels.

In the assembled screen, as illustrated in FIGS. 4 and 5, the elastic cable extends directly from one anchorage flap 12 within a neighboring panel of one array, said anchorage flap 12 having been adhered to an inner surface 19 of the panel proximate an outer edge 20 of the screen, to an anchorage flap 12 inside another panel of the other array adhered to an inner surface 19 thereof proximate an opposite outer edge 21 of the screen. Said anchorage flaps 12 are positioned such that the elastic cables extend coaxially with the axes of the corresponding apertures 3 through which each cable extends without abrupt changes in direction between their anchorage points 13, thereby reducing undue stress at the apertures and minimizing tearing with repeated use.

The anchorage flaps 11, 12 enhance the rigidity of the panel. They also spread the load developed in the elastic cable over an area of the backing frame, thereby reducing the tendency of the panel faces to pillow out or bulge.

Figure 3:
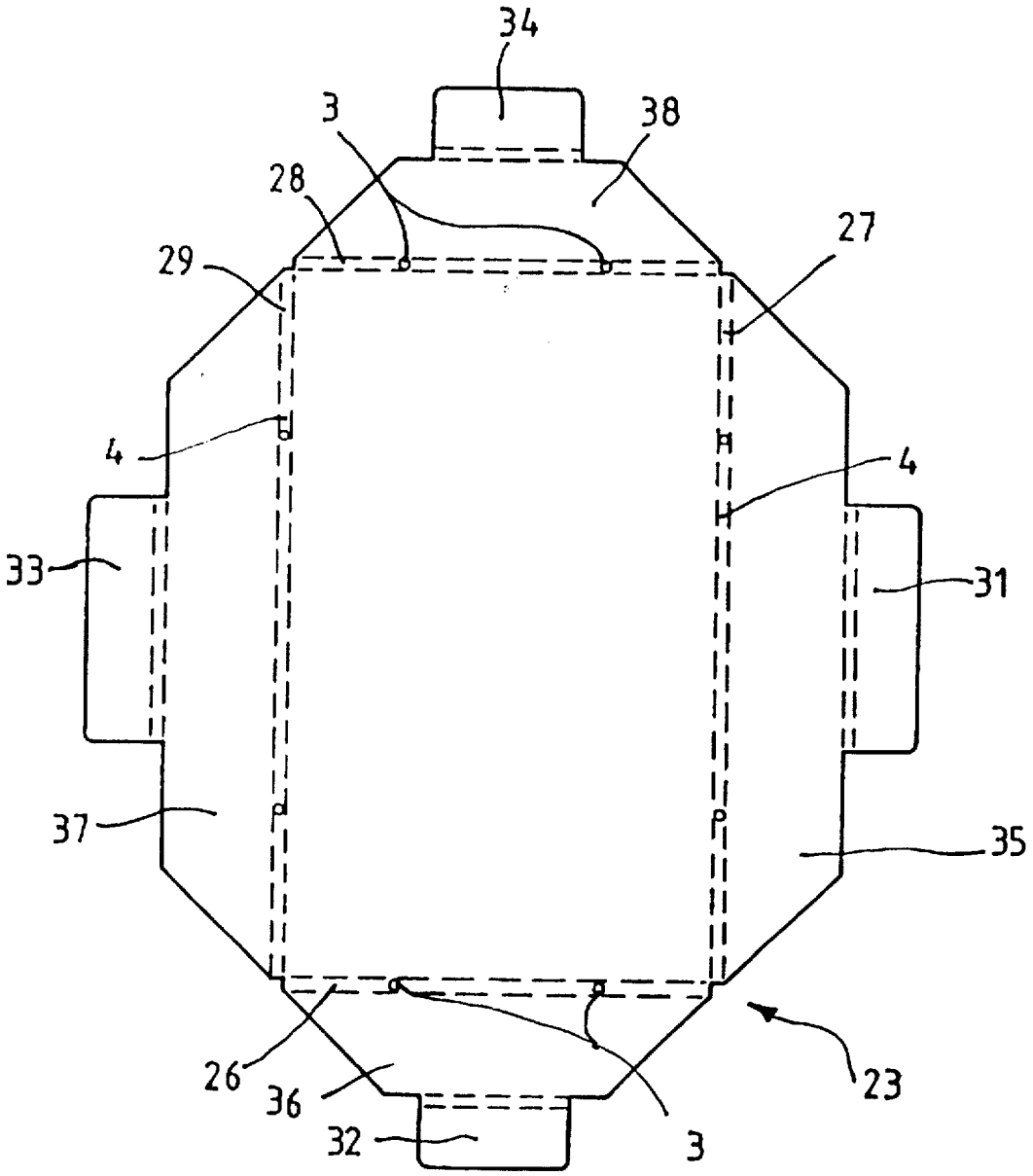
FIG. 3 is a plan view of a blank of a backing frame, being a component of a panel constituting a component of the screen shown in FIG. 1, drawn to a larger scale.

Each illustrated panel comprises a backing frame and a cover element. The backing frame and the cover element are formed of corrugated B flute, two-ply board. The cover element is in the form of cover plate 22. The cover plate 22 overlies the backing frame and is adhered thereto to define a laminar panel. The backing frame comprises a shallow box 17, as illustrated in FIG. 4, formed from a cut and scored cardboard blank 23, as illustrated in FIG. 3, the blank 23 being adapted to fold to form a slim rectangular prism having two major faces 24, 25 and four minor faces 26, 27, 28, 29, said minor faces abutting each other in the screen assembly and each being provided with two apertures 3, 15 through which a respective elastic cable extends. One of said major faces 24 forms the back face of a panel, the other major face 25 forms a support for the cover plate 22. Said other major face 25 is provided with a central rectangular recess portion 30.

The blank includes four integral flaps 31–34 adapted to fold along score line to support four portions 35, 36, 37, 38 of the blank forming said other major face a predetermined height above the back face of the panel. These flaps 31, 32, 33, 34 are adhered to the inner surface of the one major face and assist in providing rigidity to the backing frame.

An anchorage flap 12 is also adhered to the inner surface 19 of the one major face 24 within said recess portion 30. Said anchorage flap 12 is provided with two anchorage points 13 so that two elastic cables 2 may be anchored to each flap 12. Each minor face is provided with two corresponding apertures through which elastic cable may extend. Each minor face is adapted to be maintained in edge-to-edge abutment with a minor face of another panel by means of said elastic cables. The cables extend between neighboring panels through said apertures but otherwise remain substantially within the confines of the backing frame, and consequently substantially within the confines of the screen edges. Each anchorage flap 12 is adhered to an inner surface of the panel proximate an outer edge of the screen. Said anchorage flaps are positioned such that each elastic cable extends substantially coaxially with the axes of the corresponding apertures 3 through which each cable extends without abrupt changes in direction between their anchorage points 13.

In the end panels 9, 10 of each array 5, 6, a transverse anchorage flap 11 is adhered to the inner surface 19 of the one major face 24 within said recess portion 30. Said transverse anchorage flap 11 is also provided with two anchorage points 18 so that two elastic cables 14 may be anchored thereto. In this case each elastic cable 14 extends directly from said transverse anchorage flap 11 within one said panel 9 through three intermediate panels 1 to a transverse anchorage flap 11 in the other said panel 10. The elastic cable 14 therefore extends substantially in a straight line through the panels between its anchorage points 18, thereby reducing the tendency of the panel to be torn where the cables pass through the minor faces.

The cover plate 22 is formed of the same material as the backing frame, however, the cover plate 22 is in the form of sheet material. The plate is a cut rectangular section having square cut, square butt or otherwise sharp edges. The plate 22 is positioned to overlay the front face 25 of the backing frame, then adhered thereto to form a rectangular prism panel presenting a neat sharp edge 41 about one face thereof. This facilitates the presentation of a screen having a full feature face substantially free of unsightly joints between neighboring panels and facilitates alignment between neighboring panels.

To assemble a panel, the pre-cut and scored blank 23 is folded along score lines to form a slim rectangular prism as illustrated in FIG. 4.

Four flaps 31–34 are folded to rest on the inner face 19 of the backing frame so that four portions 35–38 of the blank forming the cover plate support face of the backing frame are held a predetermined height above said inner face 19. Once adhered in position these assist also in maintaining the rigidity of the backing frame. The folded and adhered flaps provide for rigid support at the center of each panel to reduce pillowing or bulging.

Anchorage flap 12 is positioned within the backing frame. A first end of a first cable 2 is tied through anchorage point 13 in the flap 12, and a first end of a second cable 2 is tied to the other anchorage point 13. Each cable then extends through its respective aperture in an edge wall 3 of the panel adapted to abut a neighboring panel.

The anchorage flap 12 is aligned and then adhered onto the inner face 19 of the backing frame proximate an edge of the panel remote from the abutting edge.

In panels 9, 10 forming the end panels of an array 5, 6 a transverse anchorage means 11 is positioned and adhered to the inner face 19 of the backing panel, transverse to the first anchorage flap 12.

A first end of a cable 14 is tied to one anchorage point 18 in said transverse flap 11 and the cable 14 is extended through an aperture 15 in a contacting edge of the panel and a first end of another cable 14 is tied to another anchorage point 18, and the cable is extended through another aperture 15 in that same wall.

The transverse flap 11 is then aligned and adhered onto the said inner face.

The support flaps 31–34 are then adhered onto said inner face.

The cover plate 22 is then aligned with the edges of the backing frame and adhered to the support portions 35–38.

Conveniently the cable is threaded through corresponding apertures prior to gluing the flaps to form the backing frame, and clearly the backing frames forming the screens must be arranged and tied together before the cover plates are affixed to each backing frame.

It will be appreciated that details of the panel and the screen can vary considerably with the broad requirements of the present invention to achieve a lightweight folding screen. It is accordingly to be understood that the invention is not limited to the specific construction illustrated and described herein, and that the invention extends to other embodiments within the scope of the claims.

For example, all flaps are adhered in the preferred embodiment but these may be stapled or otherwise mounted. Alternatively, the anchorage flaps may in some instances be part cut out portions extending integrally from the backing frame. Further two cables are shown secured to each anchorage flap, however each cable may be secured to a distinct anchorage flap in each panel.

It has been found that the use of internal flaps creates structural stability over the front face of the panels which would otherwise pillow out, that the use of a panel comprising a backing frame and a separate cover element permits easier application of graphics to the cover element, and that a separate cover element provides for easier integration of graphics between neighboring panels to form mosaics.

It has also been found that the separate cover element allows for other materials such as foam board, plastics and art board to be introduced to improve structural stability and the graphic appeal of a partition.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A screen comprising at least two panels inter-connected in edge-to-edge array by elastic thread means, each panel comprising a cover element and a backing frame wherein the backing frame is formed from a cut and scored cardboard blank, the blank being adapted to fold to form a slim rectilinear prism having two major faces and three or more minor faces, said minor faces abutting each other in the screen assembly and each being provided with a number of corresponding apertures through which said elastic thread means extends, one of said major faces forming a support for the cover element, the other major face forming the back face of a panel, and wherein the backing frame is overlaid with the cover element to define a laminar panel, and anchorage means in the form of an anchorage flap adhered to an inner face of marginal panels of the screen to secure said thread means, said anchorage means being positioned so that the line of action of each thread means extends substantially unidirectionally from one anchorage means to another and the thread means extend without abrupt direction change intermediate the anchorage means.

2. A screen according to claim 1, wherein each said anchorage means is mounted remote from an abutting edge of the marginal panel in which said anchorage means is located.

3. A screen according to claim 2, wherein each anchorage means is in the form of a flap provided with two spaced apart anchorage points enabling two thread means to be secured to it.

4. A screen according to claim 3, wherein said one major face is provided with a central recess portion.

5. A screen comprising at least two panels interconnected in edge-to-edge array by elastic thread means, each panel comprising a cover element and a backing frame wherein the backing frame is formed from a cut and scored cardboard blank, the blank being adapted to fold to form a slim rectilinear prism having two major faces and three or more minor faces, said minor faces abutting each other in the screen assembly and each being provided with a number of corresponding apertures through which said elastic thread means extends, one of said major faces forming a support for the cover element, the other major face forming the back face of a panel, and wherein the backing frame is overlaid with the cover element to define a laminar panel, said blank including integral flaps adapted to fold along score lines to support portions of the blank forming said one major face at a predetermined distance from the back face of the panel, and wherein the integral flaps are secured to the inner surface of the other major face to enhance the rigidity of the backing frame.

6. A screen comprising two or more panels assembled in edge-to-edge array and elastic thread means, adapted to maintain neighboring panels in edge-to-edge abutment, extending through corresponding apertures in abutting edge walls of the neighboring panels, wherein each marginal panel of the array is provided with at least one anchorage means in the form of an anchorage flap adapted to anchor the elastic thread means and adapted to enhance the rigidity of the panel by spreading the load developed in the elastic thread means over an area of the panel.

7. A screen according to claim 6, wherein said anchorage means are positioned so that the line of action of each thread means extends substantially unidirectionally from one anchorage means to another and the thread means extend without abrupt direction change intermediate the anchorage means.

8. A screen according to claim 7, wherein said anchorage means is in the form of an anchorage flap adhered to an inner face of the panel in which it is located.

9. A screen according to claim 8, wherein each said anchorage means is mounted remote from an abutting edge of the panel in which it is located.

10. A screen according to claim 9, wherein each anchorage means is in the form of a flap provided with two spaced apart anchorage points enabling two thread means to be secured to it.

11. A screen according to claim 10, wherein said one major face is provided with a central recess portion.

12. A screen according to claim 6, wherein the blank includes integral flaps adapted to fold along score lines to support portions of the blank forming said one major face at a predetermined distance from the back face of the panel, and wherein the integral flaps are secured to the inner surface of the other major face to enhance the rigidity of the backing frame.

13. A screen comprising at least two panels interconnected in edge-to-edge array by elastic thread means, each panel comprising a first member and a second member, the first member being formed from a cut and scored blank, the blank being adapted to fold to form a rectilinear prism having two major faces and three or more minor faces wherein at least one minor face is provided with at least one aperture through which elastic thread means extend and the second member being a flat sheet mounted to overlie one major face of the first member, wherein marginal panels of the array include at least one anchorage flap adhered to an inner face and adapted to secure an end of said thread means and enhance the rigidity of the panel, said anchorage flaps being positioned so that the line of action of each thread means extends substantially unidirectionally from one anchorage means to another and the thread means extend without abrupt direction change intermediate the anchorage means.

14. A screen according to claim 13, wherein each said anchorage means is mounted remote from an abutting edge of the panel in which it is located.

15. A screen according to claim 14, wherein each anchorage means is in the form of a flap provided with two spaced apart anchorage points enabling two thread means to be secured to it.

16. A screen according to claim 15, wherein said one major face is provided with a central recess portion.

17. A screen according to claim 13, wherein the blank includes integral flaps adapted to fold along score lines to support portions of the blank forming said one major face at a predetermined distance from the back face of the panel, and wherein the integral flaps are secured to the inner surface of the other major face to enhance the rigidity of the backing frame.

* * * * *